US007232163B2

(12) United States Patent
Weselak

(10) Patent No.: US 7,232,163 B2
(45) Date of Patent: Jun. 19, 2007

(54) SLIDING DOOR LOCK

(76) Inventor: George Weselak, 184 Summit Ave., Thunder Bay, Ontario (CA) P7B 3P4

( * ) Notice: Subject to any disclaimer, the term of this patent is extended or adjusted under 35 U.S.C. 154(b) by 0 days.

(21) Appl. No.: 11/205,013

(22) Filed: Aug. 17, 2005

(65) Prior Publication Data

US 2007/0040394 A1 Feb. 22, 2007

(51) Int. Cl.
*E05C 19/18* (2006.01)

(52) U.S. Cl. ..... 292/292; 292/DIG. 46

(58) Field of Classification Search ..... 292/288, 292/289, 292, 295, DIG. 46, 283, 284
See application file for complete search history.

(56) References Cited

U.S. PATENT DOCUMENTS

| | | | | | |
|---|---|---|---|---|---|
| 290,400 | A | * | 12/1883 | Coe | 292/292 |
| 3,071,957 | A | | 1/1963 | Golub | |
| 3,094,861 | A | | 6/1963 | Sayles | |
| 3,451,235 | A | * | 6/1969 | Weingart | 70/14 |
| 3,922,893 | A | | 12/1975 | Berg | |
| 3,956,911 | A | | 5/1976 | Corboud | |
| 4,040,653 | A | * | 8/1977 | Takahashi | 292/202 |
| 4,268,074 | A | | 5/1981 | Alexander | |
| D272,041 | S | * | 1/1984 | Harris et al. | D8/330 |
| D283,672 | S | * | 5/1986 | Greco | D8/331 |
| 4,861,079 | A | | 8/1989 | DeForrest, Sr. | |
| 5,228,731 | A | | 7/1993 | Glass | |

* cited by examiner

*Primary Examiner*—Gary Estremsky
(74) *Attorney, Agent, or Firm*—Hoffman, Wasson & Gitler, P.C.

(57) ABSTRACT

A first L-shaped bracket is secured to the door and has an aperture aligned with an aperture extending through the door. A second L-shaped bracket having substantially the same size and shape as the first bracket has a rod which, in the locking position, extends through the aperture in the door bracket and door. In the non-use position, the rod extends through an aperture in the outwardly extending section of the door bracket. The outwardly extending section of the door bracket also has a second aperture. The handled bracket has an aperture on each section aligning with the second aperture in the outwardly extending section to accommodate a padlock.

12 Claims, 3 Drawing Sheets

SLIDING DOOR LOCK

BACKGROUND OF THE INVENTION

Sliding closures, such as sliding doors and sliding windows, have a panel mounted on tracks allowing them to slide laterally in order to open and close. The closure may consist of two panels covering the opening or a single panel. A jamb surrounds the opening.

For safety and security reasons, locks are provided on sliding closure to prevent unwanted opening or access. The locks, in one form or another, prevent movement of the closure along the tracks. U.S. Pat. No. 4,268,074 (Alexander) discloses a rod extending through an aperture in sliding closures. When inserted, the rod prevents sliding of the closures. Another U.S. patent, U.S. Pat. No. 3,922,893 (Berg), discloses a sliding door locking device having a bolt extending through two sliding closures and screwed into a bracket on one side of the closures. A second bracket on the other side of the closures has an aperture through which the bolt extends. A padlock prevents unauthorized removal of the bolt. U.S. Pat. No. 4,861,079 (Deforest Sr.) discloses a locking bolt having two brackets, each on a side of a sliding closure. A bolt extends through the two brackets and a padlock secures the bolt.

It is an object of the invention to provide a lock having a lockable use and lockable non-use position.

It is another object of the invention to provide a lock which may be used as a handle to open and close the door or window.

It is another object of the invention to provide a lock for sliding closures which may be added to existing doors and windows.

It is another object of the invention to provide a lock for a sliding door which is easy and inexpensive to manufacture and install.

It is still another object of the invention to provide a lock preventing sliding of a door or window.

SUMMARY OF THE INVENTION

A first L-shaped bracket is secured to the door and has an aperture aligned with an aperture extending through the door. A second L-shaped bracket having substantially the same size and shape as the first bracket has a rod which, in the locking position, extends through the aperture in the door bracket and door. In the non-use position, the rod extends through an aperture in the outwardly extending section of the door bracket. The outwardly extending section of the door bracket also has a second aperture. The handled bracket has an aperture on each section aligning with the second aperture in the outwardly extending section to accommodate a padlock.

DETAILED DESCRIPTION OF THE INVENTION

Figure 1:
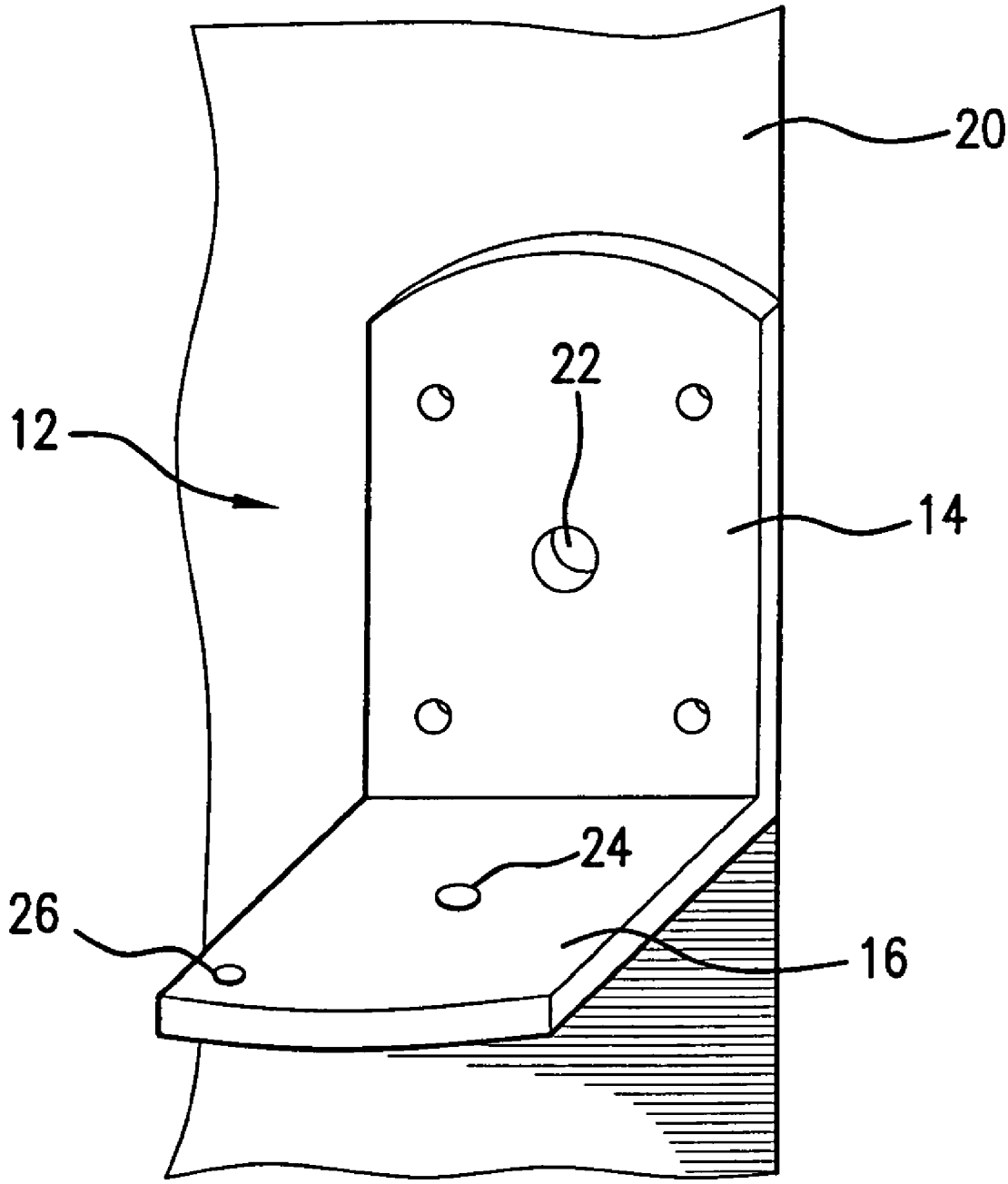
FIG. 1 depicts the door bracket attached to a door.

A base bracket 12 is secured to a door 20 as seen in FIG. 1. In order to prevent sliding of the door, it is preferred that the bracket be connected near the edge of the door. The base bracket is secured in any suitable manner, such as screws. The back 14 of the L-shaped bracket has a first aperture 22. This aperture 22 aligns with an aperture extending through the door 20.

The bottom 16 of the L-shaped base bracket 12 extends outwardly from the door. A second hole 24 is formed in the central part of the bracket and a third hole 26 is formed along the edge of the bracket.

Figure 2:
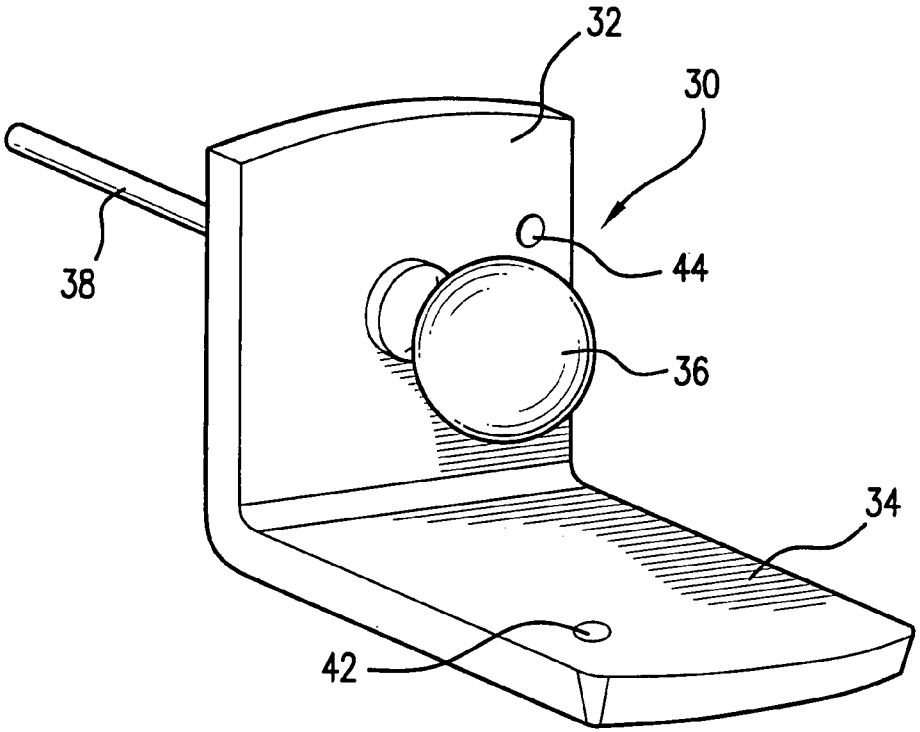
FIG. 2 is a perspective view of the handle bracket.

FIG. 2 depicts the handle bracket 30 having a back portion 32 and bottom portion 34 to form an L shape. The back portion 32 has a handle 36, such as a knob, allowing for easy grasping and movement of the handle bracket. The rod 38 extends from the opposite side of the back portion. In use, the rod 38 extends through the first aperture 22 and door 20. In so doing, the rod 38 extends through the opposite side of the door and, when the door 20 is slid, the rod will strike the second panel closing the doorway or the door jamb to prevent further sliding. The bottom portion 34 has a fourth aperture 32 and the back portion 32 has a fifth aperture 44.

Figure 3:
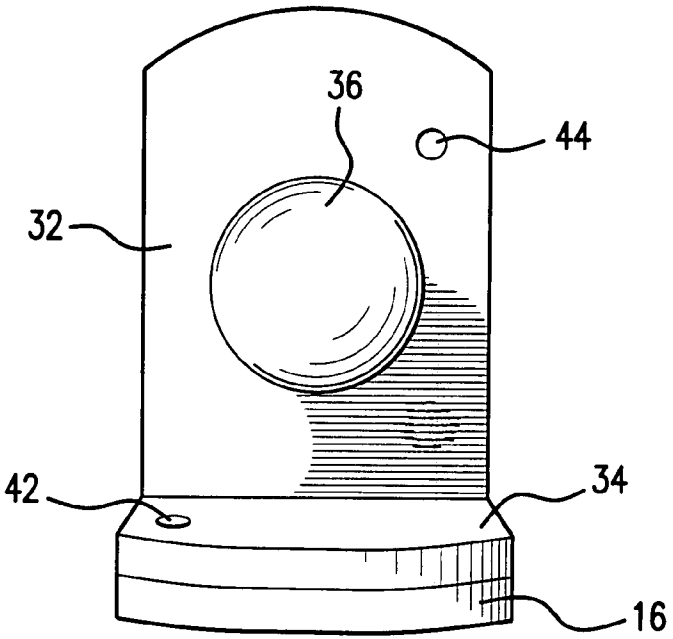
FIG. 3 is a front view of the handle bracket placed on the base bracket in a locking position.

FIG. 3 shows the handle bracket engaged with the base bracket. As mentioned previously, in this position, the rod 38 extends through the first aperture 22 allowing the rod to present an obstacle to sliding of the door. The handle bracket is sized so that when mating with the base bracket, the edges of the handle bracket align with the edges of the base bracket. Also, the fourth aperture 42 aligns with the third aperture 26. This alignment of apertures allows a lock, such as a padlock, to be passed through the two apertures 26, 42. The lock prevents the unauthorized removal of the handle bracket from the base bracket.

Figure 4:
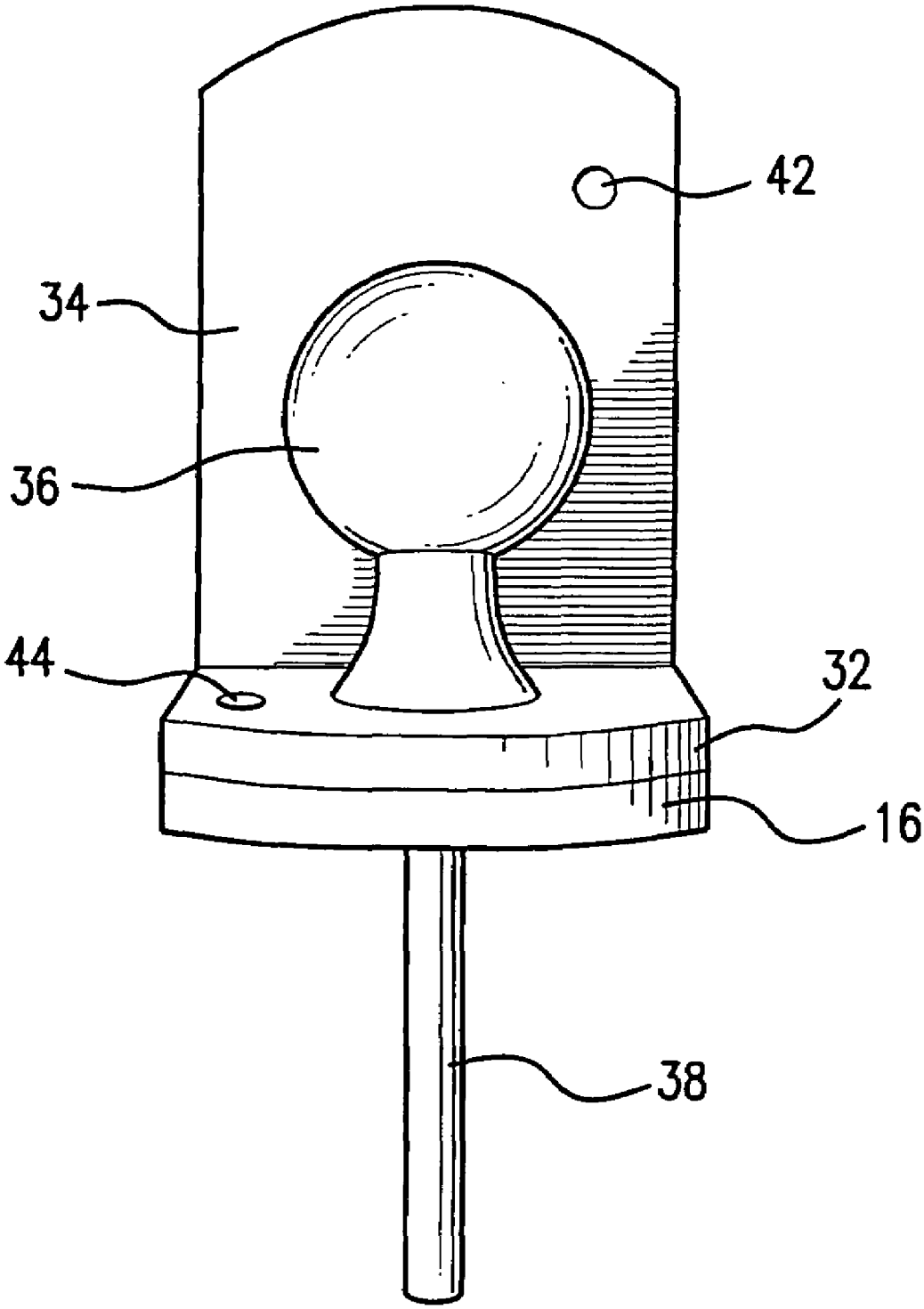
FIG. 4 is a front view of the handle bracket placed on the base bracket in the non-use position.

FIG. 4 shows the non-use position of the sliding door lock. In this position, the rod 38 passes through the aperture 24 in the bottom portion 16 of the base bracket. Again in this position, the edges of the handle bracket align with the edges of the base bracket when the back portions of the two brackets are brought into contact. In this position, the knob 36 or the rod 38 can be used as a handle for sliding of the door and the fifth aperture 44 now aligns with the third aperture 26 allowing for a lock to be secured through the two apertures to prevent movement or removal of the handle bracket.

The device presents a simple, effective way to prevent sliding of a door or window by passing a bar through the door that blocks sliding movement. The device also has a non-use position allowing the door bracket and handle bracket to be locked together to prevent removal and to be used as a handle for sliding of the door or window.

While the invention has been described with reference to a preferred embodiment, variations and modifications would be apparent to one of ordinary skill in the art. The invention encompasses such variations and modifications which do not depart from the spirit of the invention.

What is claimed is:

1. A lock, comprising a first bracket, said first bracket having a first upright section, and a second outwardly extending portion;

a first aperture formed in a central portion of said first upright portion;

a second aperture formed in said second portion;

a second bracket having a third portion and a fourth portion;

a rod extending from one side of said third portion, said rod connected to and extending from said second bracket and fitting through said first aperture;

a third aperture formed in said fourth portion, said third aperture aligning with said second aperture when said rod extends through said first aperture, and a fourth aperture in a central portion of said second portion, said rod extending through said fourth aperture when the lock is in a non-use position.

2. The lock of claim 1, further comprising a fifth aperture in said third portion, said fifth aperture aligning with said second aperture when said rod extends through said fourth aperture.

3. The lock of claim 1, wherein said second aperture is proximate an edge of said second portion.

4. The lock of claim 1, further comprising a handle extending from said third portion.

5. The lock of claim 1, wherein said rod is unitarily formed with said second bracket.

6. The lock of claim 1, wherein said first bracket and said second bracket are L-shaped.

7. A locking system, comprising a door having an aperture, a first bracket having a first section and a second section, said first section attached to the door, and having a first aperture, said first aperture aligned with said door aperture, said second section extending outwardly from said door, said second section having a first aperture, a second bracket having a third section and a fourth section, a rod extending from said third section a second aperture in said second section, an aperture in said third section, said second aperture in said second section aligned with said aperture in said third section when said rod extends through the first aperture of the second section.

8. The locking system of claim 7, further comprising a first aperture in said fourth section.

9. The lock of claim 7, wherein said first bracket and said second bracket are L-shaped.

10. A locking system, comprising a door having an aperture, a first bracket having a first section and a second section, said first section attached to the door, and having a first aperture, said first aperture aligned with said door aperture, said second section extending outwardly from said door, said second section having a first aperture, a second bracket having a third section and a fourth section, a rod extending from said third section, a first aperture in said fourth section a second aperture in said second section, a second aperture in said fourth section, said second aperture in said second section aligned with said second aperture in said fourth section when said rod extends through the first section first aperture.

11. A lock, comprising a first L-shaped bracket, said first bracket having a first upright section, and a second outwardly extending portion;

a first aperture formed in a central portion of said first portion;

a second aperture formed in said second portion;

a second L-shaped bracket having a third portion and a fourth portion; and a rod extending from one side of said third portion, said rod connected to and extending from said second bracket and fitting through said first aperture a third aperture formed in said second portion, a fourth aperture formed in said fourth section, said fourth aperture aligning with said third aperture when said rod extends through said first aperture.

12. The lock of claim 11, further comprising a fifth aperture formed in said fourth section, said fifth aperture aligning with said third aperture when said rod extends through said second aperture.

* * * * *